United States Patent [19]

Genest

[11] Patent Number: 4,616,491

[45] Date of Patent: Oct. 14, 1986

[54] KEY OPERATED ELECTRONIC LOCK

[76] Inventor: Leonard J. Genest, 1061 Tropic La., Santa Ana, Calif. 92705

[21] Appl. No.: 615,221

[22] Filed: May 30, 1984

[51] Int. Cl.[4] ..... E05B 47/00

[52] U.S. Cl. ..... 70/276; 70/278; 70/413

[58] Field of Search ..... 70/276, 277, 278, 413; 361/191; 340/825.31; 307/10 AT; 235/382.5

[56] References Cited

U.S. PATENT DOCUMENTS

| | | | |
|---|---|---|---|
| 4,399,673 | 8/1983 | Gotanda | 70/278 |
| 4,414,831 | 11/1983 | Perkjt | 70/278 |
| 4,507,944 | 4/1985 | Widen | 70/278 |

*Primary Examiner*—Robert L. Wolfe

*Attorney, Agent, or Firm*—Beehler, Pavitt, Siegemund, Jagger & Martella

[57] ABSTRACT

A special type of key is made use of to actuate an electronically triggered release mechanism to unlock a door. To enable the electronic means to function, insertion of the key in the keyway initially closes a switch to energize the electronic circuit. Also when the key reaches the switch closing position, a read head for the electronic circuit, located adjacent the keyway, interprets magnetic coding carried by the key. The electronic circuit is programmed to motivate a motor driven mechanism to move a locking pin out of engagement with a latch bolt where the latch bolt has been acting to hold a door locked. Once the locking pin has been removed, the latch bolt is in fact withdrawn from its locked position by rotation of the key in a substantially normal fashion.

49 Claims, 17 Drawing Figures

Fig. 3.
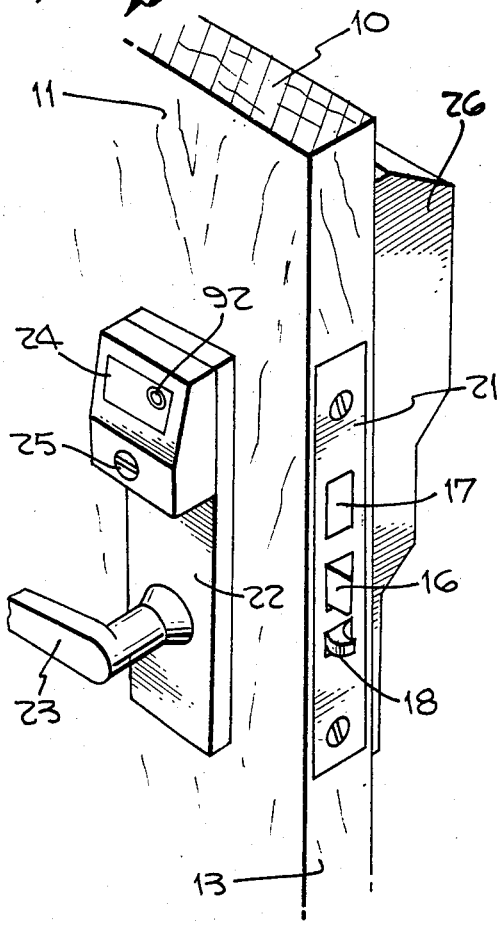
Fig. 1.
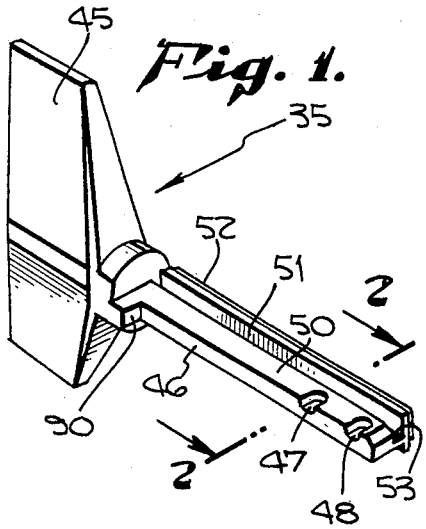
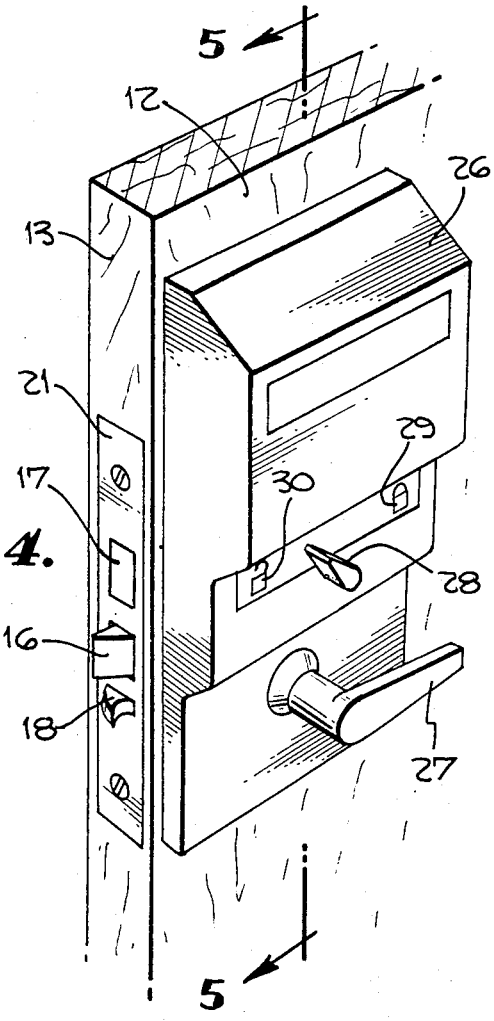
Fig. 4.
Fig. 2.
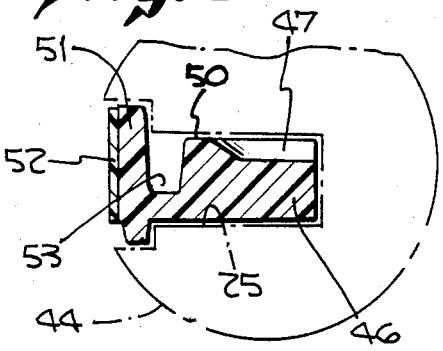

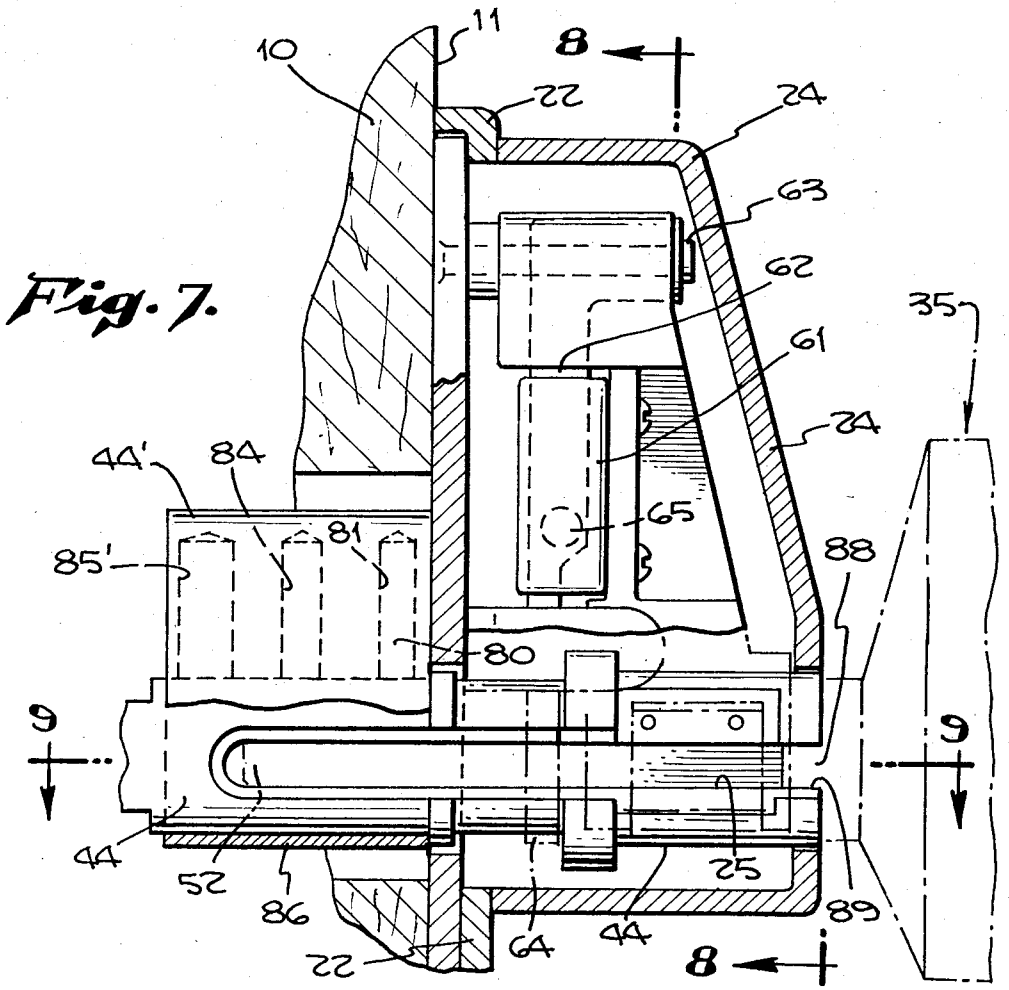
Fig. 7.
Fig. 8.
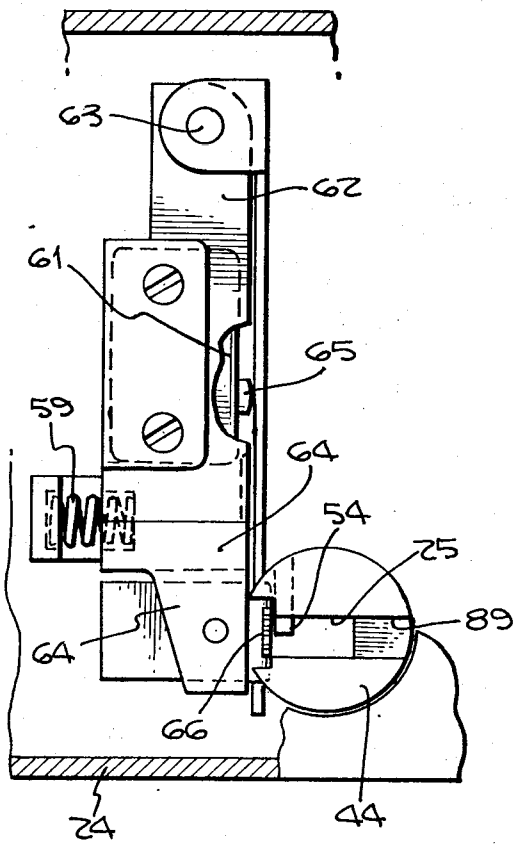

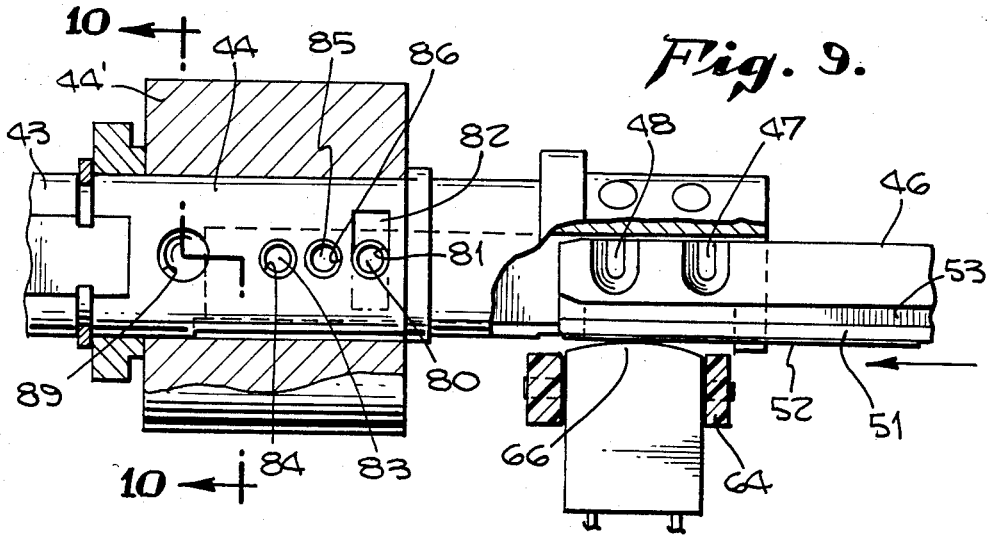
Fig. 9.
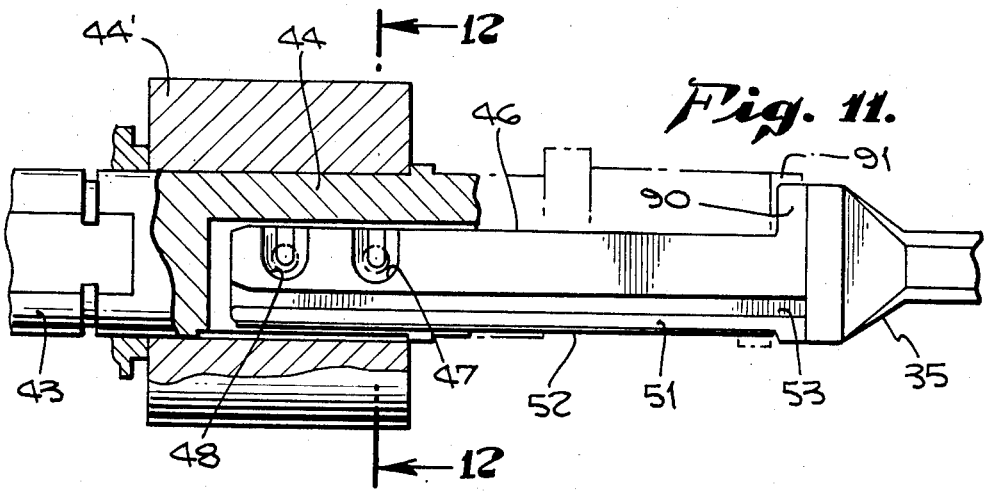
Fig. 11.
Fig. 10.
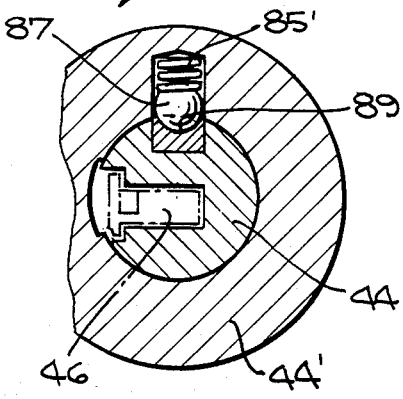
Fig. 12.
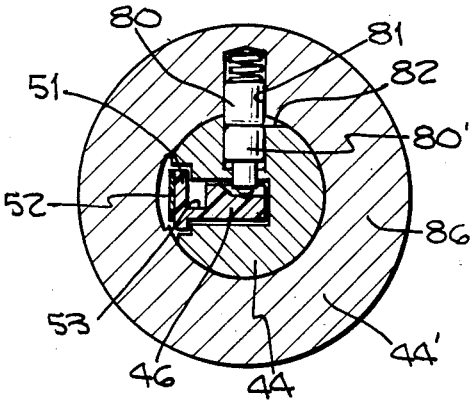

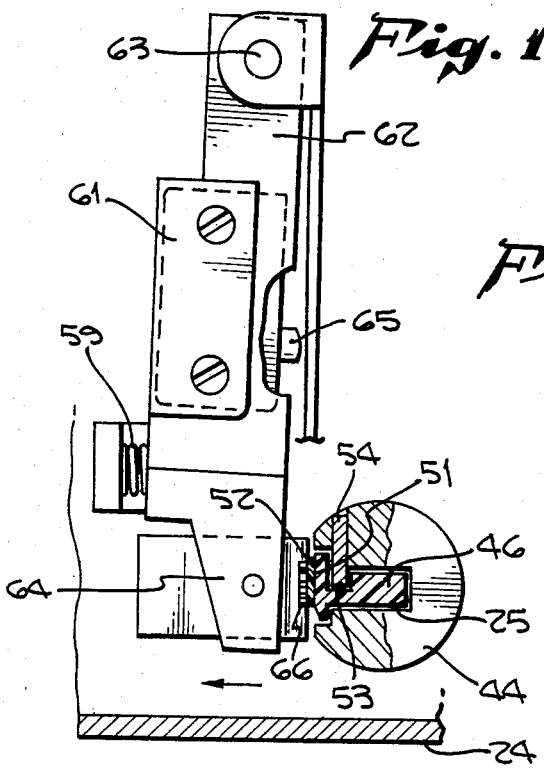
Fig. 13.
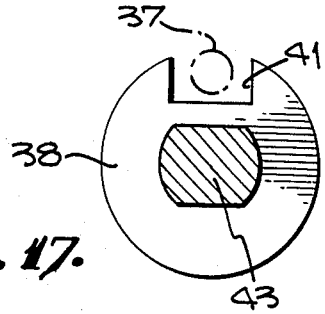
Fig. 17.
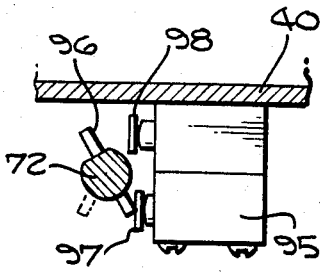
Fig. 16.
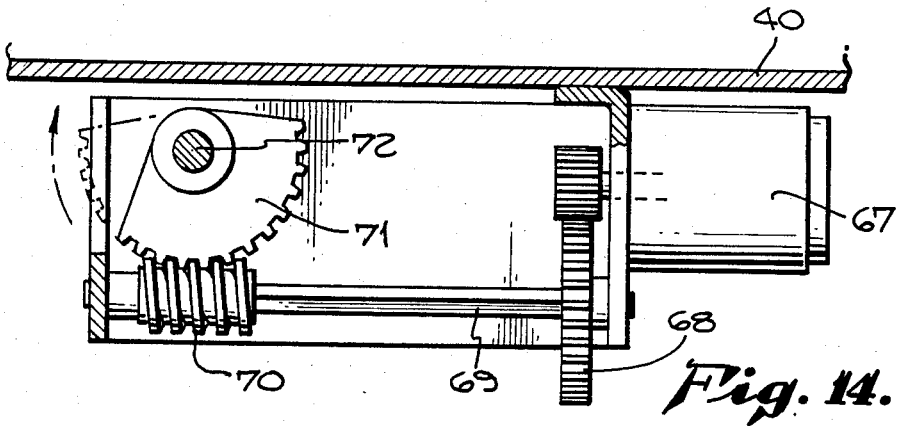
Fig. 14.
Fig. 15.
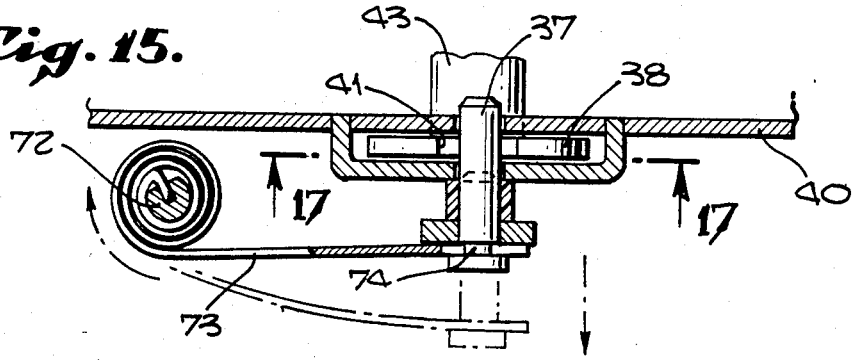

KEY OPERATED ELECTRONIC LOCK

When adapting electronic circuits to sundry mechanisms for locking and unlocking door locks, the industry heretofore has gravitated toward use of magnetically coded cards as the vehicle for motivating the circuit to perform the locking and unlocking operations. Cards coated with a magnetic material are capable of accepting a multiple number of combinations of coded information far in excess of the number of combinations that would be possible with a conventional key.

Although such cards are inexpensive, easily coded reliably, and readily recoded where necessary, the card expedient is not without its limitations. Cards can, for example, become damaged by abuse and wear to a greater degree than metallic keys. Specially constructed card slots need to be devised and provided.

Irrespective of the advantages cards enjoy, serving as a replacement for keys, when a door of most any kind is to be locked and unlocked, the public in general had been so preconditioned from centuries of practice in reliance on keys that insertion of a key in a keyhole followed by rotation of the key is recognized as the most acceptable locking and unlocking expedient.

Conventional metal keys do, however, have objectionable disadvantages. Such keys are relatively heavy and the key blanks are relatively expensive compared to cards. The need for constantly cutting new keys to replace those lost or misplaced is a burden, especially in the operation of hotels where many units change hands on a daily basis.

It is accordingly among the objects of the invention to provide a new and improved key actuated expedient for an electronic lock which embodies the singular advantages of magnetic coding to energize the electronic program and which at the same time has the natural acceptability of a conventional key.

Another object of the invention is to provide a new and improved key actuated expedient for an electronic lock which has many of the attributes of a conventional key operation by having it turn to withdraw the latch bolt and reverse for a portion of the turn in order to withdraw the key on the right-hand or left-hand side of the door and which also triggers the electronic keying so that only the authorized key is capable of unlocking the lock.

Still another object of the invention is to provide a new and improved key actuated expedient for an electronic lock of such character that it is the key itself which unlocks and locks the door, when authorized by the electronic release.

Still another object of the invention is to provide a new and improved key actuated expedient for an electronic lock which makes use of an actual key carrying package of magnetic coding cooperable with the electronic circuit, the key being of a character relatively inexpensive in first cost and cost of replacement in the event of loss.

Further included among the objects of the invention is to provide a new and improved key actuating expedient for an electronic lock wherein the magnetic coding can be readily erased if need be and subsequently recoded with a different code, and further which provides a keying expedient well adapted to master keying needs.

Further included among the objects of the invention is to provide a type of interchangeable key for an electronic lock which performs multiple functions directed in part to energizing and deenergizing the electronic circuit, activating the read head of the circuit and also the function of physically manipulating the latch bolt as one continuous operation.

Included among objects of the invention is to provide such a key which is adapted to engage an appropriate complementary keyway in a fashion such that the keyway and consequently the key can be changed to enhance the individuality of a chosen installation and thereby further inhibiting duplication by unauthorized persons.

Included additionally among the objects of the invention is to provide a new and improved lock pin arrangement of a character which positively blocks manipulation of the latch bolt and which can be advantageously withdrawn only when a properly authorized key is inserted in the lock mechanism, the invention further including a dead bolt mechanism subject to manipulation in company with certain aspects of the electronically implemented latch bolt mechanism as an additional security factor.

With these and other objects in view, the invention consists of the construction, arrangement and combination of the various parts of the device serving as an example only of one or more embodiments of the invention, whereby the objects contemplated are attained, as hereinafter disclosed in the specification and drawings, and pointed out in the appended claims.

FIG. 1 is a perspective view of a typical key for the key operated electronic lock.

FIG. 2 is a cross-sectional view on the line 2—2 of FIG. 1.

FIG. 3 is a fragmentary perspective view of a portion of a door showing the key actuated electronic lock mounted in place as viewed from the outside.

FIG. 4 is a fragmentary perspective view of the lock appearing on a portion of the door as viewed from the inside.

FIG. 7 is a fragmentary sectional view through the key actuated portion of the lock.

FIG. 8 is a fragmentary sectional view on the line 8—8 of FIG. 7.

FIG. 9 is a cross-sectional view on the line 9—9 of FIG. 7 showing the key in one position.

FIG. 10 is a sectional view on the line 10—10 of FIG. 9.

FIG. 11 is a view similar to FIG. 9 but showing the key in a different position.

FIG. 12 is a sectional view on the line 12—12 of FIG. 11.

FIG. 13 is an end elevational view of a switch actuated by the key.

FIG. 14 is a cross-sectional view on the line 14—14 of FIG. 6.

FIG. 15 is a cross-sectional view on the line 15—15 of FIG. 6.

FIG. 16 is a fragmentary cross-sectional view on the line 16—16 of FIG. 6.

FIG. 17 is a fragmentary sectional view on the line 17—17 of FIG. 15.

Figure 5:
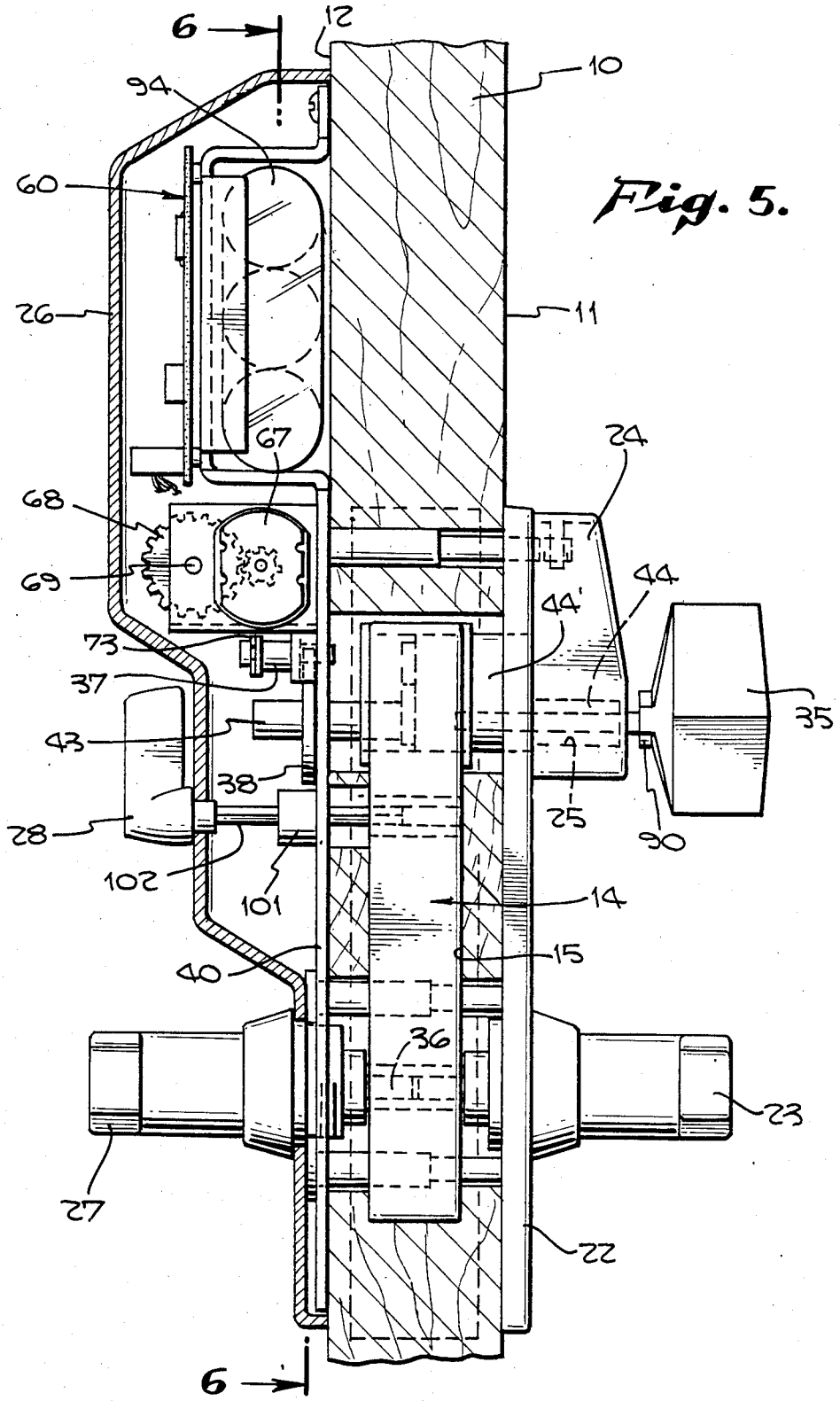
FIG. 5 is a longitudinal sectional view on the line 5—5 of FIG. 4.
Figure 6:
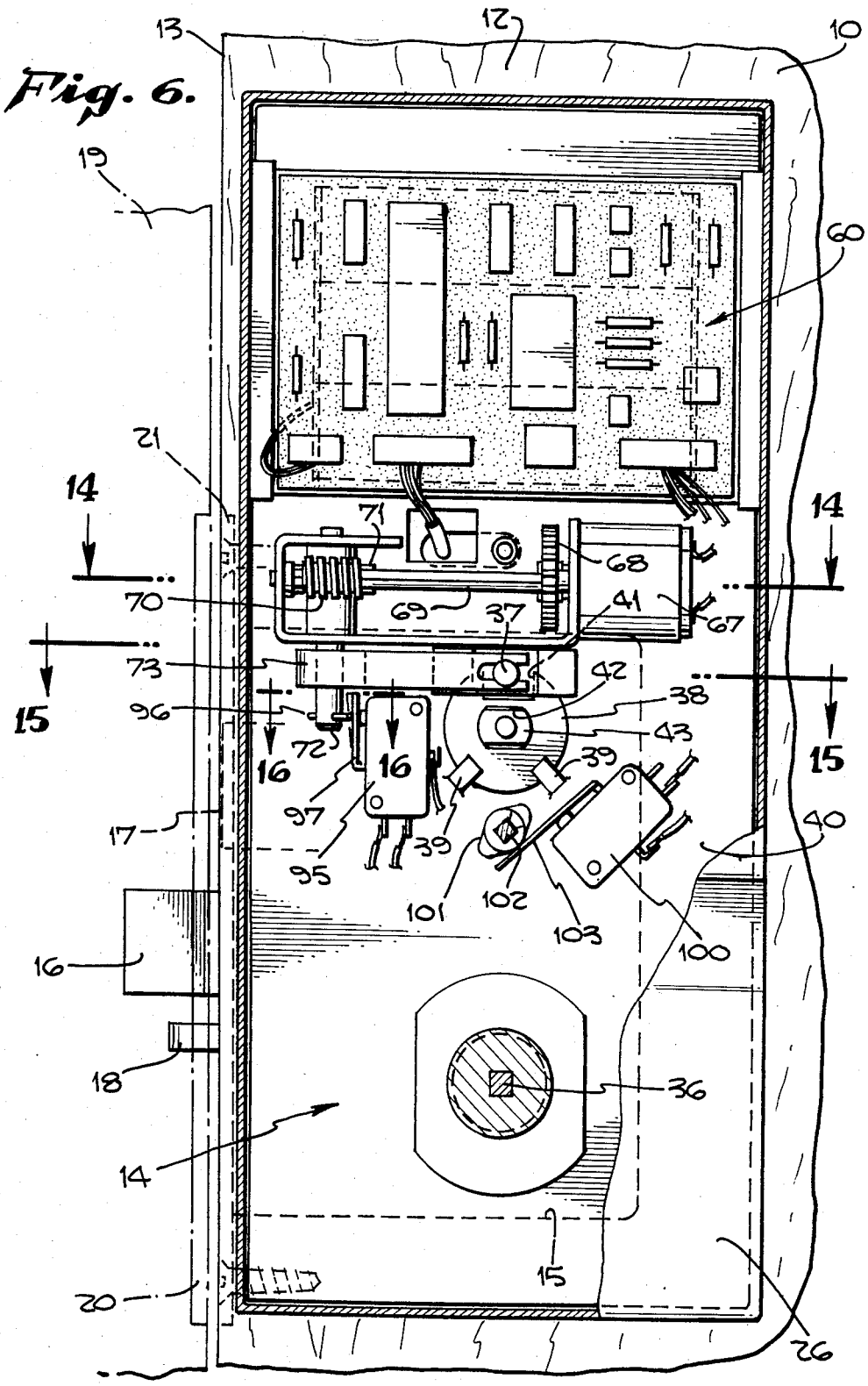
FIG. 6 is a longitudinal sectional view on the line 6—6 of FIG. 5.

In an embodiment of the invention chosen for the purpose of illustration and in particular as appears in FIGS. 3 and 4, there is shown a section of a conventional hinged type door 10 having an outside face 11, an inside face 12, and an edge face 13. The locking mechanism shown in cooperation with the mechanism of the invention is embodied in a substantially conventional mortise type lock indicated generally by the reference character 14 which is lodged in a mortise recess 15 between opposite outside and inside faces 11 and 12 of the door, as shown in FIG. 5, and extending inwardly from the edge face 13, as shown in FIG. 6. The mortise type lock provides a latch bolt 16, a dead bolt 17, and an auxiliary bolt 18 functioning in a substantially conventional manner, as disclosed in U.S. Pat. No. Re. 26,677, structural details of which have been omitted in the interest of simplicity and clarity in focusing upon the innovative features of the present invention.

Following conventional practice, the door is adapted to cooperate with a door frame 19 supporting a strike plate 20 located opposite an edge plate 21, which is part of the mortise type lock 14, the edge plate being provided with appropriate recesses through which pass the latch bolt 16, the dead bolt 17, and the auxiliary bolt 18.

Further, as shown in FIGS. 3, 4, 5 and 6, there is an outside cover plate 22 providing a mounting for a handle lever 23 which may be grasped for opening the door and an auxiliary cover housing 24 in which a keyway 25 is located.

An inside cover plate 26 located on the inside face 12 of the door provides a mounting for an inside handle lever 27 for manipulation of the latch bolt 16 and a thumb turn lever 28 for manipulation of the dead bolt 17. Knobs may on occasion be substituted for the handle levers 23 and 27. In FIG. 4 the thumb turn lever is directed counterclockwise to an unlocked indicator 30. A locked indicator 29 is on the opposite side.

In the chosen embodiment the arrangement is one wherein when the door is closed with the latch bolt 16 extended and the auxiliary bolt 18 depressed in a conventional fashion, the door is locked from the outside and can be unlocked only by use of a key 35, shown partially inserted in FIG. 5. At the inside the handle lever 27 acting through a spindle 36 and the substantially conventional mortise type lock 14 serves to withdraw the latch bolt 16 so that the door can be unlatched and opened. The mortise lock mechanism with which the inside handle lever 27 is associated operates directly and bypasses any activity associated with the key 35.

To hold the latch bolt 16 in locked position, subject only to withdrawal by manipulation of an authorized key, there is provided a locking pin 37 serving as a blocker, centerably disposed with respect to FIGS. 5 and 6, and shown in additional detail in FIG. 15. In order for the locking pin 37 to block manipulation by key 35, use is made of a washer 38 held in place by tabs 39 on an inside mounting plate 40. There is a notch 41 in the washer 38 which receives the locking pin 37, in that way to block rotation of the washer 38. The washer in turn has a non-circular hole 42 for reception of an extension 43 of a cylinder plug 44 which is subject to rotation by the key 35 within a lock body 44' in the form of a cylinder. In order to withdraw the locking pin 37, the electronic components must be activated by a properly authorized key 35 in order for the latch bolt to be withdrawn by a person on the outside of the door, in spite of the fact that the cylinder plug 44, subject to key operation, is interconnected by conventional linkage to the mortise type lock 14 to the latch bolt 16.

The key 35, shown in some detail in FIG. 1, has a handle 45 with an elongated shank 46 which carries key cuts 47 and 48 on an upper face 50. A flange 51, running the length of the shank 46, carries a magnetic strip 52 which bears electronic coding. The flange 51 is spaced from the shank 46 to provide a groove 53, as shown also to good advantage in FIGS. 2 and 13. A complementary flange 54 on the cylinder plug 44 serves as a guide for the shank of the key as it is inserted into the keyway 25.

When the lock is to be unlocked from the outside, insertion of the key into the keyhole serves initially to energize an appropriate electronic circuitry embodied in part in a printed circuit indicated generally by the reference character 60, housed and shown within the inside cover plate 26. For energizing the electronic circuitry, there is a switch 61 in the outside cover housing 24, some particulars of which are advantageously shown in FIGS. 7 and 8. The switch 61 is mounted on an arm 62 which swings about a pivot 63, a lower end 64 of the arm being in a position adjacent the keyway 25, as shown in FIG. 8, wherein a button 65 is depressed, normally holding the circuit open, and deenergized. To shift the switch 61 from the open or deenergized position of FIG. 8 to the closed or energized position of FIG. 13, it is necessary only to insert the shank 46 of the key 35 into the keyway 25. The shank has a breadth sufficient so that the lower end 64 of the arm 62 is moved physically in a direction from right to left, as viewed in FIGS. 8 and 13. When the switch is in the position of FIG. 13, the button 65 is extended and the circuit energized.

As the shank 46 of the key is inserted into the keyhole 25, by reason of the key shank being sufficiently broad, the lower end 64 of the arm 62 is physically shifted in a direction from right to left, as viewed in FIGS. 8 and 13, against tension of a coiled spring 59. Movement of the arm 62 allows the button 65 to extend to the position of FIG. 13, in which position electronic circuitry is energized. As the shank 46 continues to be inserted into the keyhole 25 for its full depth, the magnetic strip 52 is moved into engagement with a read head 66 carried by the arm 62.

When the coding on the magnetic strip is the authorized and correct coding for which the electronic circuitry has been programmed, a motor 67, shown in FIGS. 6 and 14, will be actuated. Actuation of the motor 67 serves to withdraw the locking pin 37 from its blocking or locking position. To accomplish this, there are provided pinions 68 on a shaft 69 which carries a worm gear 70. Worm gear 70 acting through a gear segment 71 rotates a shaft 72 in a clockwise direction, as viewed in FIG. 14. Clockwise rotation of the shaft 72 results in clockwise rotation of a spring arm 73, the end of which engages a groove 74 of the locking pin 37 beneath a head 75. Movement of the spring arm 73 and the locking pin from the solid line position of FIG. 15 to the broken line position serves to withdraw the locking pin from its blocking or locking position within notch 41 of the washer 38. As has been previously noted, this serves to release the cylinder plug 44 so that by continued rotation of the key 35, the latch bolt 16 can be withdrawn and the door opened by pulling on the outside handle lever 23. FIG. 3 presumes a right-hand mounting of the locking mechanism for a door hinged on the left. The mounting can be as readily reversed for left-hand operation with a door hinged on the right.

Where the spring arm 73 is attached to the shaft 72 an adjacent portion of the arm is spirally wound. When the shaft 72 is rotated in a direction, clockwise as in FIG. 15, to withdraw the locking pin 37 there is an initial low power progressive build-up of tension in the spirally wound portion to an amount sufficient to withdraw the locking pin. Conversely, for rotation of the shaft 72 in reverse direction there is a progressive low power build-up of spring tension in a reverse direction to a degree sufficient to shift the locking pin into a locking or blocking position.

The key 35 in addition to carrying the coded magnetic strip 52 on its shank 46 also is provided with certain aspects of conventional keying of the type used in cylinder locks. The key cuts 47 and 48, previously identified, are adapted to cooperate with a pin tumbler arrangement. One set of such pin tumbler arrangements is made use of, varied in alternate respects, for left and right-hand mounting, depending on whether the hardware is for use on a left-hand or right-hand opening door. In the example shown the handle 45 of the key is rotated counterclockwise when the latch bolt 16 is to be withdrawn, as viewed in FIG. 3. For this there is a set of pin tumblers 80, 80' in a pin tumbler bore 81, with a gash 82 clockwise from the bore 81. There is a set of pin tumblers 83 in another innermost pin tumbler bore 84 which is for the purpose of preventing withdrawal of key 35 from the keyhole 25 when the cylinder plug is turned. In the absence of such an arrangement, pins would be released from pin bores and impair further operation of the lock.

In the example shown in FIGS. 9, 10 and 11 of the drawings, when the key is inserted and the key cut 47 coincides with the tumbler bore 81, the depth of the cut 47 is such that a shear line between tumblers 80 and 80' coincides with the floor of the gash 82. Counterclockwise rotation, FIG. 12, is prevented by the wall of the bore 81 bearing against the upper tumbler 80. Presence of the gash 82, however, allows clockwise rotation of the cylinder plug 44 and consequent withdrawal of the latch bolt 16 by key action.

Conversely, locating the gash 82 on the opposite or counterclockwise side, suggested by the broken lines in FIG. 9, would enable withdrawal of the latch bolt by rotation in the opposite direction. This would be the preferred direction of rotation for a door hinged at the opposite side.

A third set 85 of pin tumblers may be provided, if desired, in an appropriate bore 86.

To further assure dependable performance of the key, there is provided a spring actuated detent 87 in the cylinder 44' which houses the cylinder plug 44, as shown in FIG. 10, the spring detent being received in a recess 89 in the cylinder plug. Action of the spring detent is relied upon to hold the key shank 46 steadily in proper position in order to secure an accurate reading of the code on the magnetic strip 52 by the read head 66. The shank is inserted for its full depth within the keyhole 25, in which position a crosspiece 90 lodges in a transverse slot 91 in the cylinder plug 44, see FIG. 11, having been shifted inwardly from the exposed position of FIG. 5.

In that the locking device is electronically motivated, it is convenient to employ a visible signal such as a light emitting diode (LED) at a location 92 on the exterior cover housing 24. Properly connected and wired to the thumb turn 28 and its mechanism, the LED may be illuminated when the dead bolt 17 is extended as a signal to maid service, for example, that the premises are occupied.

In the chosen embodiment power for the electronic circuitry is provided by a battery pack 94 behind the printed circuit 60, as shown in FIG. 5. The battery pack likewise provides electrical energy for operation of the motor 67. Motor power calls upon the battery pack only when the locking pin is being moved and an automatic cut-off and reversing component 95 is provided, shown in FIGS. 6 and 16. For manipulation of the component there is provided an actuator pin 96 at the lower end of the shaft 72 which is driven by the gear train. As the shaft is rotated in an initial direction in order to withdraw the locking pin 37 in the manner previously described, the actuator pin serves to depress a switch armature 97 at the fully withdrawn position of the locking pin. The action just described serves through an appropriate component to cut off further supply of electrical energy to the motor.

Subsequently when the key is withdrawn, operation of the motor 67 is reversed and the shaft 72 rotates in reverse direction enabling the spring arm 73 to return the locking pin 37 to initial locking or blocking position. At the end of this movement the opposite end of the actuator pin 96 depresses a second switch armature 98, the action of which is to again interrupt the supply of electrical energy to the motor 67 and set the system for reverse operation.

As a security expedient the electronic lock can be so programmed that the dead bolt 17 can be extended and withdrawn from locked position only by the occupant of the room with the aid of the thumb turn lever 28. To prevent withdrawal of the dead bolt 17 by a key operation, there is provided a switch component 100, as shown in FIG. 6. For activating the switch component, an actuator button 101 is provided on a rod 102 on which the thumb turn 28 is mounted. When the thumb turn 28 is rotated a distance sufficient to fully extend the dead bolt 17, the actuator button 101 shifts the position of an arm 103 of the switch component 100, in that way to so condition the electronic circuit that the key 35, even when correctly coded, cannot activate the motor 67 in order to withdraw the lock pin. When the thumb turn has subsequently been rotated in reverse direction to itself withdraw the dead bolt 17, the arm 103 is released and through the switch component 100, the circuit is returned to initial operating condition. Electronic circuitry can, however, be so programmed that the dead bolt, although extended, can in fact be withdrawn by a special key arrangement.

While a particular embodiment of the present invention has been shown and described, it will be obvious to those skilled in the art that changes and modifications may be made without departing from the invention in its broader aspects and, therefore, the aims of its appended claims are to cover all such changes and modifications as fall within the true spirit and scope of this invention.

Having described the invention, what is claimed as new in support of Letters Patent is as follows:

1. A key operated electronically programmed release mechanism for enabling manipulation of a latch bolt comprising a frame having therein an extendable and retractable latch bolt, a blocker having a first position blocking movement of the latch bolt and a second position removed from said first position, a motor in operable engagement with the blocker for moving the blocker between said positions, an electrically programmed actuating circuit for said motor, a lock mechanism comprising a lock body having a key responsive element mounted therein, said key responsive element having a keyway and a key for said keyway, operating means interconnecting said latch bolt and said key responsive element for shifting said latch bolt between locked and unlocked positions, an activating means for said actuating circuit, magnetic coding on said key and a read head in the actuating circuit and subject to said magnetic coding when the key is in the keyway whereby said coding is adapted to implement activation of said actuating circuit to a condition wherein said blocker is shifted by motor action to enable manipulation of said latch bolt by key movement.

2. A key operated electronically programmed release mechanism as in claim 1 wherein said activating means has an extension adjacent said keyway and said key has a shank complementary with respect to said keyway, the configuration of said shank being one which when inserted in the keyway is adapted to shift the extension to a position wherein said actuating circuit is energized.

3. A key operated electronically programmed release mechanism as in claim 2 wherein said extension has a pivotal mounting on said lock body, said activating means and said read head having positions on and carried by said extension.

4. A key operated electronically programmed release mechanism as in claim 1 wherein said read head has a location on said extension in reading position relative to said magnetic coding when the shaft of the key is in engagement with the extension.

5. A key operated electronically programmed release mechanism as in claim 1 wherein said keyway has a longitudinally extending guiding configuration and said key shank has longitudinally extending configurations complementary with respect to the guiding configuration of said keyway.

6. A key operated electronically programmed release mechanism as in claim 1 wherein said lock mechanism is a tumbler lock having a plurality of spaced tumbler locations, tumbler means at one of said tumbler locations being adapted upon rotation of the rotatable element to a latch bolt operative position to inhibit withdrawal of the key.

7. A key operated electronically programmed release mechanism as in claim 6 wherein tumbler means at one of the tumbler locations is subject to adjustment to enable rotation of said rotatable element in the alternative in one direction or in the opposite direction.

8. A key operated electronically programmed release mechanism as in claim 6 wherein there is resilient detent means acting between said lock body and said rotatable element at a location coincident with interfacing of said magnetic coding and said read head whereby to facilitate the reading of said coding.

9. A key operated electronically programmed release mechanism as in claim 8 wherein said resilient detent means comprises a spring pressed element in said lock body, said rotatable element having a recess therein receptive of said spring pressed element.

10. A key operated electronically programmed release mechanism as in claim 1 wherein said lock body and said rotatable element interface at a shear line and said lock mechanism comprises a tumbler lock having a plurality of spaced tumbler locations, tumbler means at said locations having positions relative to the shear line enabling rotation of the rotatable element when the magnetic coding has been interfaced with said read head.

11. A key operated electronically programmed release mechanism as in claim 1 wherein said lock body comprises a cylinder barrel and said rotatable element comprises a key plug coinciding with said cylinder barrel at a shear line and there is a shank on said key for insertion into said keyway, said shank having axially spaced key cuts therein, said cylinder barrel and said key plug having a plurality of longitudinally spaced sets of tumbler bores having tumblers therein, said key cuts having operative positions respectively coincident with said tumbler bores when the depth of said key cuts relative to the tumblers enable junctions between said tumblers to coincide with the shear line thereby to enable rotation of said key plug by said key.

12. A locking mechanism and an electronically programmed release mechanism for enabling manipulation of said locking mechanism, said locking mechanism comprising a frame having therein a locking bolt movable between an extended locked position and a retracted unlocked position, a blocker having a first position blocking movement of said bolt and a second position removed from said first position and an electric motor powered means having an operable engagement with said blocker for moving said blocker between said first and second positions when energized, key means having magnetic coding thereon and read means in said release mechanism responsive to said magnetic coding for initiating operation of said release mechanism and energization of said motor.

13. A locking mechanism and an electronically programmed release mechanism as in claim 12 wherein said key means includes an extension for mechanically moving said bolt between said locked and unlocked positions and wherein said release mechanism is responsive to said magnetic coding whereby to initiate energization of said motor.

14. A locking mechanism and an electronically programmed release mechanism as in claim 13 wherein said blocker is a locking pin movable axially between a position of engagement with said extension on the key means and a position out of engagement with said extension.

15. A locking mechanism and an electronically programmed release mechanism as in claim 12 wherein said motor powered means comprises a reversible motor, a speed reducing gear train and a resilient arm interconnecting said locking pin and said gear train.

16. A locking mechanism as in claim 15 wherein said motor powered means comprises a reversible motor and a motor driven shaft, and a resilient arm interconnecting said motor driven shaft and said locking pin.

17. A locking mechanism as in claim 16 wherein one end of said resilient arm comprises a spirally coiled portion in engagement with the driven shaft.

18. A locking mechanism as in claim 17 wherein the other end of said resilient arm has a releasable operable engagement with said locking pin.

19. A key for an electronically programmed release mechanism as claimed in claim 1, the form of that portion of the key which is to be inserted into the lock corresponding to a shank and a hand hold on said shank, a keying release face on said shank for release orientation when in said keyway, a magnetic code area in an orientation on said shank for cooperation with said read head, and longitudinally extending guide means on said shank adapted for guiding engagement with said keyway when the shank is extended into said keyway for actuating engagement with said programmed release mechanism.

20. A key as in claim 19 wherein said keying release face is a tumbler engaging face and there is a face for said magnetic code area at a location rotatably removed from said tumbler engaging face, said tumbler engaging face being for reception of key cuts.

21. A key as in claim 19 wherein the thickness of said shank in a direction ninety degrees removed from said tumbler engaging face is different from the thickness in a direction normal to the tumbler engaging face.

22. A key as in claim 21 wherein the thickness of said shank in one of said directions is depended upon for energization of said actuating circuit.

23. A key as in claim 21 wherein said longitudinally extending guide means has a breadth greater than the thickness of said shank in a direction normal to said tumbler engaging face.

24. A key as in claim 23 wherein said magnetic code area is on said guide means.

25. A key as in claim 23 wherein said longitudinally extending guide means has opposite longitudinally extending edges, one of said edges being at a location removed vertically from the tumbler engaging face and the other of said edges being at a location removed vertically from the side of said shank opposite said tumbler engaging face.

26. A key as in claim 19 wherein there is a shoulder intermediate the handhold and the shank for engagement with said locking system during rotation of said key relative to said release mechanism.

27. A key as in claim 19 wherein the material of said key is a dielectric synthetic plastic resin material.

28. An electronically programmed mechanism for implementing the locking and unlocking of a door in response to a manual actuator, said mechanism comprising a frame having inside and outside faces for mounting on a door, a locking element, a mechanical linkage in engagement with the locking element for shifting the locking element between locked and unlocked positions, program responsive electronic circuitry on one side of the frame and actuator responsive means facing the other side of the frame, said mechanical linkage forming an operative association with said actuator responsive means and said locking element, a magnetically responsive read head in operative association with said actuator responsive means and in electric association with said electric circuitry, blocking means on the frame for said mechanical linkage, an electrically driven reciprocating linkage on the frame in operable engagement with said blocking means and in electrical association with said electronic circuitry, whereby to block and unblock said blocking means enabling reciprocating movement of said locking element to alternative lock and unlock positions.

29. An electronically programmed mechanism as in claim 28 wherein there is a power pack for said electronic circuitry at a location adjacent said circuitry.

30. An electronically programmed mechanism as in claim 28 wherein said reciprocating linkage is at a location on the inside of said frame adjacent an inside end of said actuator responsive means.

31. An electronically programmed mechanism as in claim 28 wherein there is a dead bolt on said frame in operative relationship with said mechanical linkage, a separate thumb turn assembly on the inside of the frame in operating relationship with said dead bolt, electric cut-off means for said electric circuitry and actuating means for said cut-off means responsive to said thumb turn assembly when the dead bolt is extended whereby to disable said electronic circuitry.

32. An electronically programmed mechanism as in claim 28 wherein said blocking means comprises a blocking element in non-rotatable engagement with said actuator responsive means having a blocking configuration, a reciprocatable locking pin on the frame having a reciprocating path of movement to stages respectively in and out of engagement with said blocking element, said locking pin being in operative engagement with said electrically driven reciprocating linkage.

33. An electronically programmed mechanism as in claim 32 wherein there is a reversing and power cut-off switch device in said electrically driven reciprocating linkage adapted to deenergize and reverse direction of said linkage at the completion of each reciprocating stage of said locking pin.

34. A electronically programmed release mechanism for enabling manipulation of a latch bolt comprising a frame having therein an extendable and retractable latch bolt, a blocker having a first position blocking movement of the latch bolt and a second position removed from said first position, motor means in operable engagement with the blocker for moving the blocker between said positions, an electronically programmed actuating circuit for said motor means, a lock mechanism comprising key responsive operating means interconnected with said latch bolt for shifting said latch bolt between locked and unlocked positions, and key responsive activating means for said actuating circuit, wherein said blocker is shifted by action of said motor means between said first and second positions to enable manipulation of said latch bolt.

35. An electronically programmed release mechanism as in claim 34 wherein said motor means is an electric motor.

36. An electronically programmed release mechanism as in claim 34 wherein said key responsive operating means is a mechanical linkage.

37. An electronically programmed release mechanism as in claim 34 wherein said key responsive activating means is an electric linkage.

38. A multi-purpose progressively operating key for an electronic locking system comprising a handhold and a shank extending from said handhold, a mechanical keying release face on said shank at one circumferential location at a location adjacent the free end of the shank, a magnetic code face on said shank at another circumferential location, and longitudinally extending mechanical guide means on said shank at a circumferential location intermediate the mechanical keying release face and the magnetic code face.

39. A key as in claim 38 wherein said mechanical keying release face is a tumbler engaging face receptive of key cuts and there is an area for said magnetic code face at a location rotatably removed from said tumbler engaging face.

40. A key as in claim 38 wherein the transverse configuration of said shank adjacent the free end comprises a mechanical switch actuating means.

41. A key as in claim 38 wherein said longitudinally extending mechanical guide means has a breadth greater than the thickness of said shank in a direction normal to said mechanical keying release face.

42. A key as in claim 41 wherein said magnetic code face is on said mechanical guide means.

43. A key as in claim 41 wherein said longitudinally extending mechanical guide means has opposite longitudinally extending edges, one of said edges being at a location spaced from the mechanical keying release face and the other of said edges being at a location spaced from the face of said shank opposite said mechanical keying release face.

44. A key as in claim 38 wherein there is a diametrically extending shoulder intermediate the handhold and the shank for engagement with said locking system during rotation of said key relative to said locking system.

45. A key as in claim 38 wherein the material of said key is a synthetic plastic resin material.

46. An electronically programmed release mechanism for enabling mechanical manipulation of a latch bolt comprising a frame having therein an extendable and retractable latch bolt, a blocker having a first position blocking movement of the latch bolt and a second position removed from this first position, motor means in operable engagement with the blocker for moving the blocker between said positions, an electrically programmed actuating circuit for said motor means, a lock mechanism comprising a key responsive operating means interconnected with said latch bolt for shifting said latch bolt between locked and unlocked positions, key activated reading means for effecting operation of said blocker and a multi-purpose key, said key comprising a mechanically keyed portion having an operative relationship with said latch bolt and adapted to effect movement of said latch bolt between locked and unlocked positions and a coded portion having an operative relationship with said key activated reading means and adapted to effect operation of said blocker between said first and second positions.

47. An electronically programmed release mechanism as in claim 46 wherein there is a switch means for said circuit including a mechanical component, said key including mechanical means for operative association with said mechanical component whereby to effect energization of said circuit.

48. An electronically programmed release mechanism as in claim 47 wherein the mechanical means for operative association with said mechanical component of the switch comprises the shank of the key.

49. An electronically programmed release mechanism as in claim 46 wherein the mechanically keyed portion of the key comprises a shank subject to rotation to effect movement of said latch bolt.

* * * * *